US007290725B1

(12) United States Patent
Brooks

(10) Patent No.: US 7,290,725 B1
(45) Date of Patent: Nov. 6, 2007

(54) EXTRUSION HEAD FOR CRUSHED ICE MAKING MACHINE WITH COMBINED BREAKER AND CUTTER

(76) Inventor: Charles A. Brooks, 7801 Industry Dr., North Little Rock, AR (US) 72117

( * ) Notice: Subject to any disclaimer, the term of this patent is extended or adjusted under 35 U.S.C. 154(b) by 0 days.

(21) Appl. No.: 11/462,594

(22) Filed: Aug. 4, 2006

(51) Int. Cl.
*F25C 1/14* (2006.01)
*B02C 11/08* (2006.01)

(52) U.S. Cl. ..... 241/65; 241/DIG. 17; 62/354

(58) Field of Classification Search ..... 241/65, 241/DIG. 17, 260.1; 62/354; 264/117–118, 264/141–143; 425/206–208, 380, 464
See application file for complete search history.

(56) References Cited

U.S. PATENT DOCUMENTS 4,429,551 A 2/1984 Hizume
4,467,622 A 8/1984 Takahashi et al.
4,741,173 A 5/1988 Neumann
5,109,679 A 5/1992 Hida
5,197,300 A 3/1993 Sakamoto et al.
5,460,014 A 10/1995 Wang
5,911,749 A 6/1999 Sugie
7,127,909 B1 * 10/2006 Brooks ..... 62/354

* cited by examiner

*Primary Examiner*—Faye Francis
(74) *Attorney, Agent, or Firm*—Head, Johnson & Kachigian, P.C.

(57) ABSTRACT

An extrusion head where continuous formation of crushed ice is formed by radially extending cutters which notch the ice rods as the rods move from the channels formed by externally protruding bosses. The extrusion head breaks ice into uniformly shaped pieces. The extrusion head has no moving parts and is easily retrofitted onto existing screw-type continuous crushed ice making machines.

6 Claims, 5 Drawing Sheets

EXTRUSION HEAD FOR CRUSHED ICE MAKING MACHINE WITH COMBINED BREAKER AND CUTTER

BACKGROUND OF THE INVENTION

1. Field of the Invention

The present invention relates to a modified extrusion head for use in a crushed ice machine. It includes a plurality of radially outward protruding wide and narrow bosses that extend longitudinally along the exterior of the extrusion head forming channels. The wide bosses extend axially from the top of the extrusion head to a distance just below the bottom of the head. The narrow bosses also extend axially along the exterior of the extrusion head from the top of the head but to a distance just above the bottom of the head. A plurality of cutters extend radially outward from the top of the extrusion head and are aligned near the center of the channels formed by the bosses. The cutters form a wedge which notch the rods of ice allowing them to break horizontally into smaller pieces of clean crushed ice cubes.

2. Prior Art

Crushed ice is a highly desired commodity especially in the restaurant and convenient store businesses. Large volumes of ice are used daily by both of these industries as well as others. As a result, many different designs have been developed for crushed ice making machines capable of forming crushed ice rapidly and continuously.

U.S. Pat. No. 4,429,551, issued on Feb. 7, 1984 to Hizume discloses an extrusion head for an auger type icemaker whose bosses extend downward over the topmost portion of the auger. The design is intended to prevent choking of crushed ice that is pushed up over the top of the extrusion head. It contemplates the use of standard methods for breaking the ice down into smaller pieces. It does not contemplate using outwardly protruding cutters to notch to ice rods allowing them to break horizontally into clean crushed ice cubes.

U.S. Pat. No. 4,467,622, issued on Aug. 28, 1984 to Takahashi et al. discloses an extrusion head specifically designed to form shaved ice. The channels of the extrusion head formed by its bosses each contain a small slit or channel that allows air to escape from the ice. This prevents excessive cooling of the ice and forms harder shaved ice particles. This patent also contemplates the use of a standard method of breaking the ice bars into shaved ice chips. It does not suggest that radially extending cutters protruding near the top of the extrusion head to aid the breaking of the ice bars into crushed ice.

U.S. Pat. No. 4,741,173, issued on May 3, 1988 to Neumann discloses an extrusion head having modified fins or bosses designed to prevent the ice column from rotating within the extrusion apparatus. As with the above two patents, it contemplates the use of an angled surface to impinge upon emerging ice bars to break up the ice. While the angled surface shown in this patent is intended to rotate, the mechanism operates in the same manner. It does not suggest the modifications made in the present invention.

U.S. Pat. No. 5,109,679 issued on May 5, 1992 to Hida discloses an auger type ice making machine having multiple blades above the extrusion head for breaking the ice rods into shaved ice pieces. The blades are adjustable so that the size of the shaved ice pieces may be readily adjusted. As with other ice breaking devices, the blades rotate at the same speed as the auger and the size of the ice pieces is adjusted by adjusting the distance between the blades. It does not suggest that modifying the extrusion head with protruding cutting wedges to notch the ice rods as an alternative method of breaking the ice rods.

U.S. Pat. No. 5,197,300 issued on Mar. 30, 1993 to Sakamoto et al. discloses an auger type ice making machine. The device disclosed in this patent has an extrusion head that bobs, or oscillates, in an up and down motion. It is intended to convey some of the load applied to the extrusion head by the auger to a cam device located above the extrusion head. As with much of the prior art, it contemplates only the use of an annular flange to break the ice rods into smaller pieces of ice.

U.S. Pat. No. 5,460,014 issued on Oct. 24, 1995 to Wang discloses an auger type ice making machine that has a unique auger-within-an-auger design. As with the other above referenced patents, this patent only contemplates the use of an annular flange to break apart the ice rods. The novelty of this patent lies in increasing the efficiency of heat transfer from the water to the FREON coolant.

U.S. Pat. No. 5,911,749 issued on Jun. 15, 1999 to Sugie discloses an auger-type ice maker. The patent discloses a specially designed boss for the formation of ice forming channels about the extrusion head. The lower end of the boss is curved in such a way as to prevent over compression of the ice. This reduces the back load on the auger, thereby increasing efficiency of the machine. It does not disclose any novel methods of breaking the ice rods or ice bars into smaller pieces of ice.

U.S. patent application Ser. No. 10/743,659 filed on Dec. 22, 2003 by Brooks discloses a modified extrusion head for use in a crushed ice machine, which includes modified bosses that break rods of ice into smaller pieces of a pre-determined size. Large and small bosses are shaped differently so as to break ice rods up into chunks. The larger bosses flange outward at the top of the extrusion head while the smaller bosses do not extend to the top of the head. This application does not disclose the presence of protruding cutters located at the top of the extrusion head and aligned in the center of the channels formed by the bosses which notch the ice rods.

The extrusion head shown in the above patents all divide a tubular sheet of ice into a series of ice rods that are then broken up into smaller pieces of ice by various devices above the extrusion head. Some of these devices are complicated and require multiple moving parts. Other devices are stationary but do not break the ice rods into uniform pieces of crushed ice. Relatively long pieces of the ice rods may remain in tact. This results in an inferior crushed ice product.

It is therefore desirable to provide means of continuously producing crushed ice having a minimum number of moving parts.

It is also desirable to provide a method of continuously producing crushed ice in which the crushed ice pieces are uniform in size.

SUMMARY OF THE INVENTION

The present invention provides a modified crushed ice extrusion head for a screw-type crushed ice machine. Existing ice machines may be easily retrofitted with the improved extrusion head. The extrusion head is cylindrical and has a series of externally protruding longitudinal bosses. The bosses alternate between wide bosses and narrow bosses. The wide bosses extend axially from the top of the extrusion head to a distance just below the bottom of the head. The narrower bosses do not extend the entire length of the extrusion head cylinder. A plurality of radially extending cutters in the shape of a wedge are located above the channels of the extrusion head. The cutters are aligned in the center of the channels formed by the bosses. The cutters notch the rods of ice as they pass through the channels allowing the rods to break horizontally into pieces of a uniform size.

It is also possible for the bosses to all be of equal size so long as the cutters have the proper configuration. The channels through which the ice rods are pushed have a bottom created by a cylindrical body of the extrusion head. Two walls are created by the bosses on either side of the channels. Located on the top of the extrusion head and being an equidistant between the walls forming the channels are outwardly protruding cutters or wedges. These cutters create a notch in the ice rods as the rods are pushed out of the channels of the extrusion head. After the ice is notched, it breaks horizontally to create clean crushed ice cubes. The resulting ice pieces have a width equivalent to approximately one-half the channel and a depth equivalent to the depth of the channel which is equivalent to the distance the bosses protrude from the cylindrical body of the extrusion head. The length of the ice pieces is dependent upon the width of the top of the cutter.

It is therefore an object of the present invention to provide a crushed ice extrusion head that does not have any moving parts and separates ice rods into uniformly shaped pieces of crushed ice.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

The extrusion head of the present invention is very similar to those of the prior art. Some of the significant differences lie in the combination of the bosses, cutters and channels through which ice is forced by the auger below the extrusion head. The cutters of the present invention notch the ice rods a they are push from the channels causing them to automatically break up. While the prior art produces crushed or flake ice of various sizes, the present invention efficiently breaks the ice rods into uniformly shaped pieces that are the same size. No moving parts are required to accomplish this. In addition, the preferred embodiment creates only a minimal and insubstantial amount of back pressure.

In one embodiment alternating wide and narrow bosses protrude from the cylindrical body of the extrusion head. Those skilled in the art will appreciate that this is a common design among crushed and flaked ice extrusion heads. The larger bosses extend the entire length of the cylinder while the smaller bosses extend up to the top of the cylinder but begin with a pointed edge slightly above the bottom of the cylinder. The walls of the bosses form channels through which the ice rods are formed. After the ice rods pass through the extrusion head channels, they are notched by a cutter in the form of a wedge located atop the extruder head. After the ice is forced through the channels and then notched, it automatically breaks along the notched groove forming ice pieces of a predetermined size.

Figure 1:
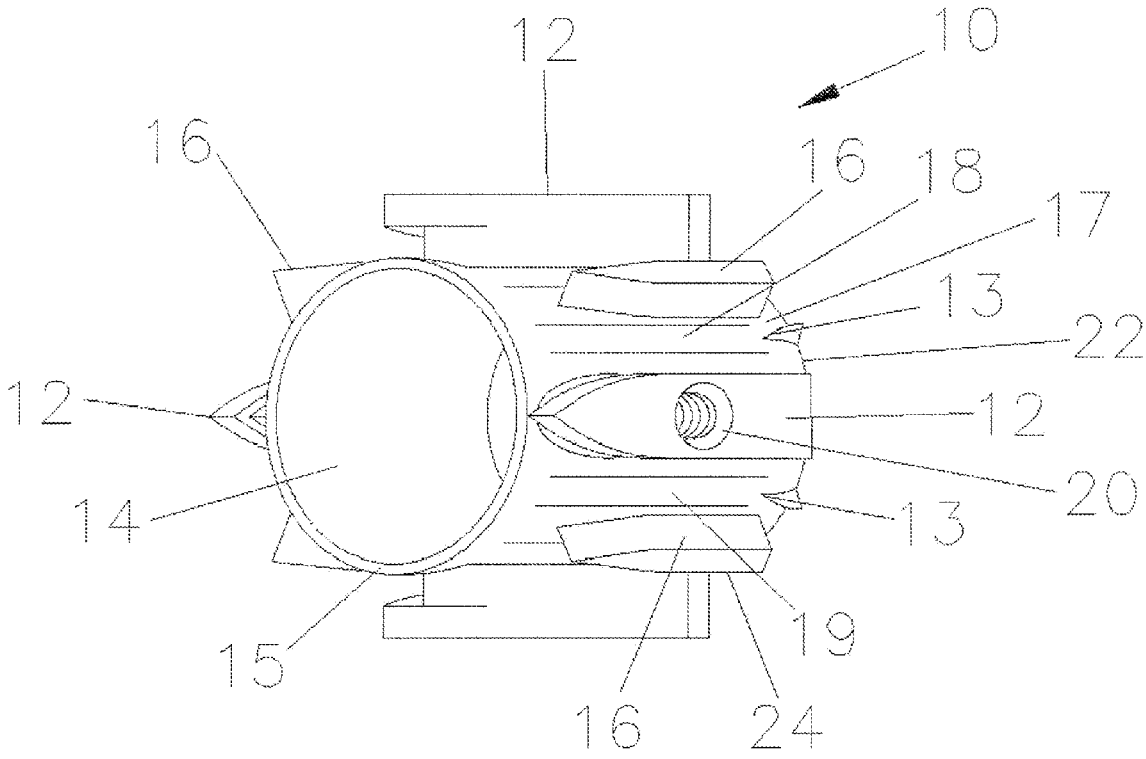
FIG. 1 shows a perspective view of the preferred embodiment of the present invention.

FIG. 1 shows a preferred embodiment of the present invention. Extrusion head 10 is comprised of a cylinder 14 that has a bottom 15 and a top 17. Running longitudinally along the cylinder are wide bosses 12 and narrow bosses 16. These form channels 18 and 19 through which rods of ice pass. Channels 18 and 19 are mirror images of one another. The ends 24 of narrow bosses 16 do not extend to the bottom of the cylinder 17. Positioned above the center of channels 18 and 19, cutters 13 protrude radially outward. In this embodiment, cutters 13 are in the form of wedges. Those skilled in the art will appreciate that cutters 13 can be a variety of shapes and forms. Wide bosses 12 also have attachment hole 20 into which a bolt is inserted to hold the extrusion head in place in the crushed ice making machine. Cutters 13 groove the rods of ice after the rods are passed through channels 18 and 19 allowing it to break horizontally at its natural breaking point. In this embodiment, a single rod of ice will be split in half to form two small cubes of ice. Those skilled in the art will appreciate that the length of the resulting cubes of ice can be altered by changing the width of the top of the cutters 13. The embodiment of the present invention prevents any significant back pressure on ice rods as they move through channels 18 and 19. Those skilled in the art will also appreciate that it makes no difference whether it is wide or narrow bosses that make up the various sides of the channels. For example, it is equally effective to have the wide bosses shortened so that they do not extend to the top end of the cylindrical body of the extrusion head while the narrow bosses extend all the way to the top of the extrusion head.

Figure 2:
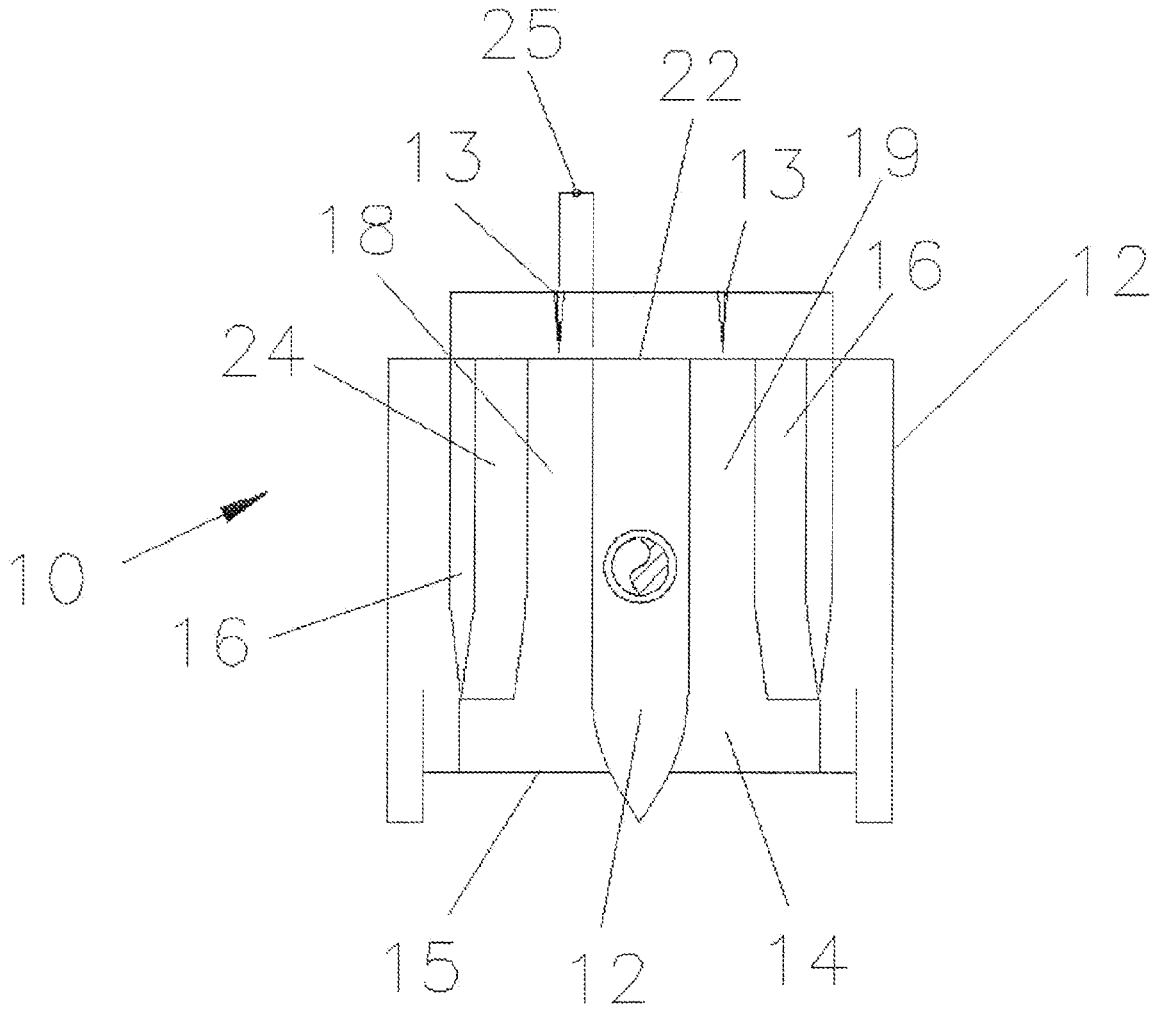
FIG. 2 shows a side view of the preferred embodiment of the present invention.

FIG. 2 shows a side view of extrusion head 10. Cutters 13 are located atop channels 18 and 19 and are positioned between wide bosses 12 and narrow bosses 16. Ends 24 of narrow bosses 16 can also be seen to not extend to the bottom 15 of cylinder 14. The distance 25 between cutters 13 and the walls of channels 18 and 19 determines the width of the crushed or flaked ice pieces.

Figure 3:
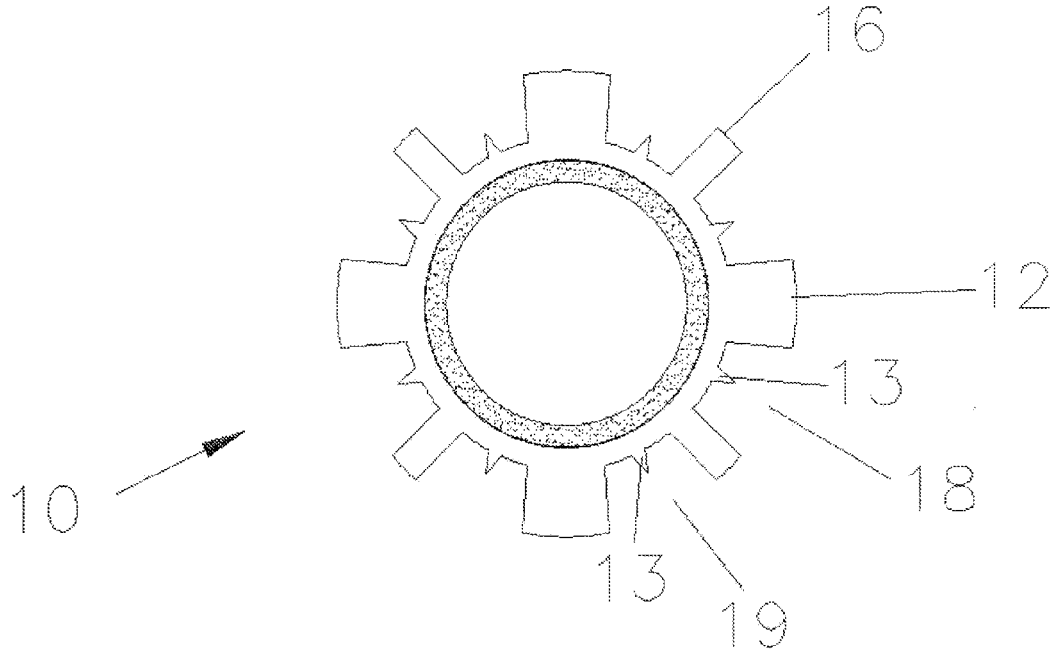
FIG. 3 shows a top plan view of the embodiment of FIG. 1.
Figure 4:
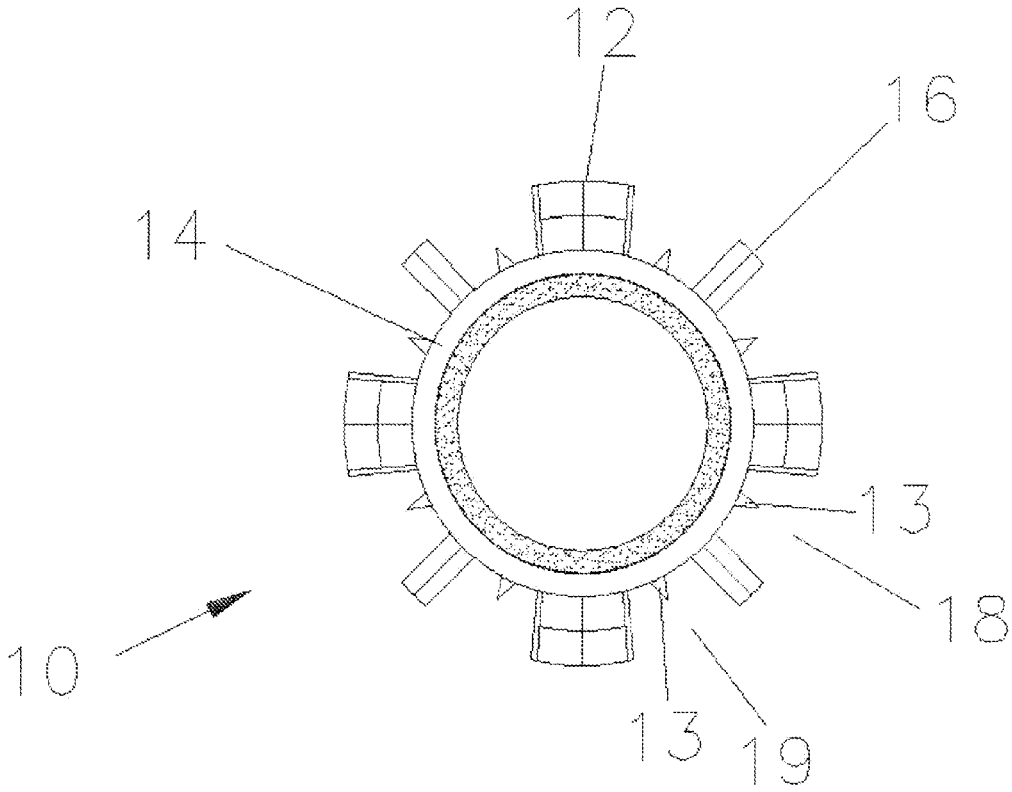
FIG. 4 shows a bottom plan view of the embodiment of FIG. 1.

FIGS. 3 and 4 show a top down and bottom up view of the extrusion head respectively. In this particular embodiment, there are four wide bosses 12 and four narrow bosses 16 that alternate around the exterior cylinder 14. This results in eight channels 18 and 19. Cutters 13 are positioned near the center of channels 18 and 19 and are located at the top of the extrusion head. Those skilled in the art will appreciate that more or less channels may be formed by changing the number of bosses. With the design of this embodiment, any number of channels may be formed so long as narrow bosses 16 and wide bosses 12 alternate. Those skilled in the art will also appreciate that cutters 13 may be located in a variety of the positions over the channels, depending upon the desired size of the crushed or flaked ice pieces.

Figure 5:
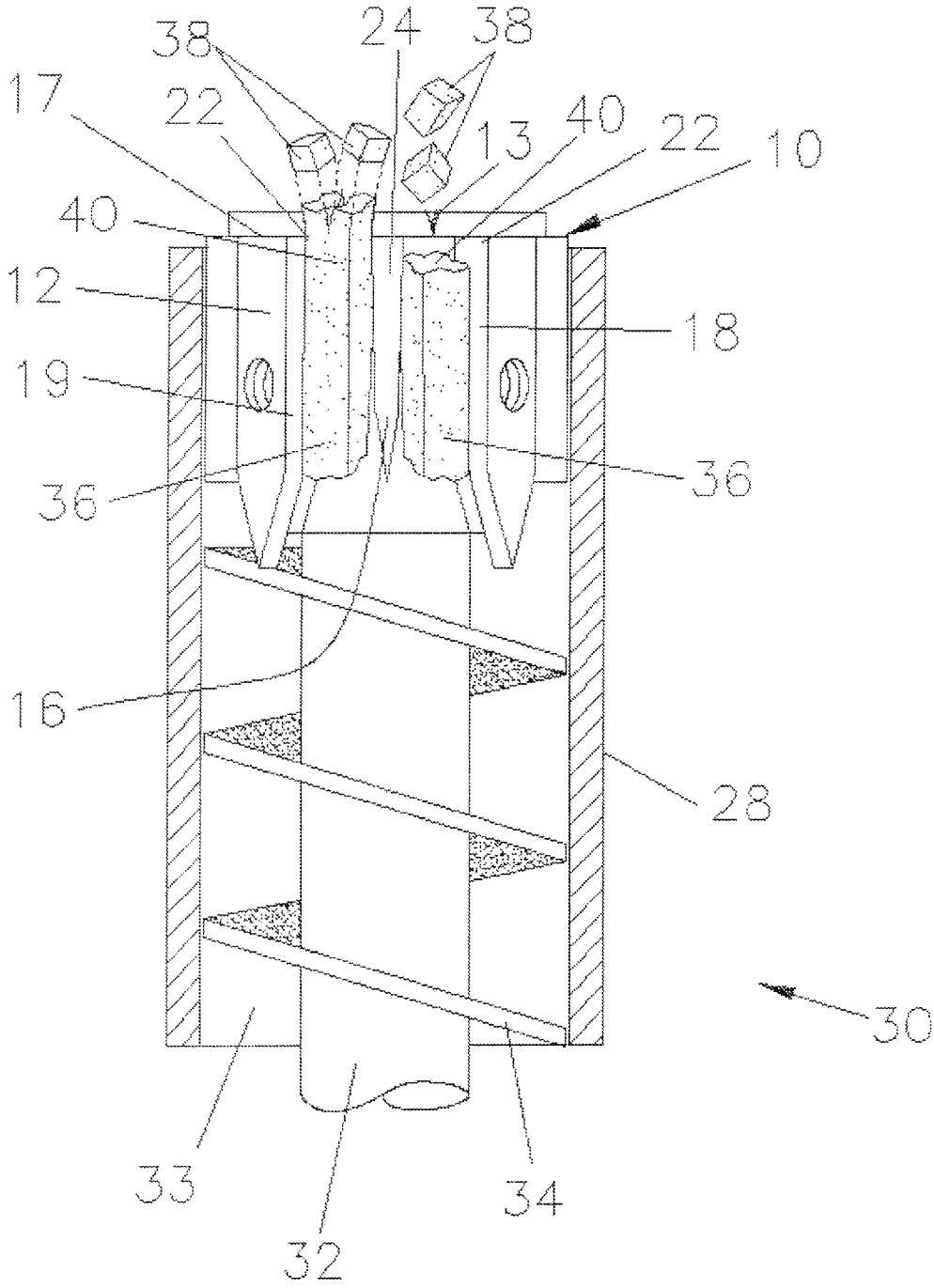
FIG. 5 shows an environmental view of the embodiment of FIG. 1.

FIG. 5 shows the extrusion head of the present invention in use in a crushed or flaked ice making machine. Those skilled in the art will appreciate that this is a typical screw or auger-type ice making machine. Extrusion head 10 rests above and on top of auger 32. Sleeve 28 fits snugly around extrusion head 10 and auger 32. Water is fed into ice making chamber 33. Sleeve 28 is surrounded by a cooling device (not shown). Auger 32 turns, and as ice is formed within chamber 33, thread 34 pushes it upward into the channels of the extrusion head. The ice forms ice rods 36. As the top of ice rods 40 pass through channels 18 and 19, they come into contact with the cutters 13 located atop of the extruder head causing ice rods 40 to be notched or grooved allowing them break up into crushed or flaked ice pieces 38. Ice pieces 38 are approximately half as wide as the channels 18 and 19. No substantial back pressure is created by this design. Furthermore, extended rods of ice do not escape from the extrusion head, and in the present embodiment, the ice rods are all divided up into crushed ice of a uniform size. The size of the crushed or flaked ice pieces can be altered by changing the distance between cutters 13 and the walls of wide bosses 12 and narrow bosses 16 of the extrusion head 17 or by changing the width of the top of the cutters 13. As will be understood by those skilled in the art, the extrusion head of the present invention may readily be inserted into existing crushed ice machines. Such retrofitted machines will have fewer parts that must be maintained, cleaned and replaced.

Whereas, the present invention has been described in relation to the drawings attached hereto, it should be understood that other and further modifications, apart from those shown or suggested herein, may be made within the spirit and scope of this invention.

What is claimed is:

1. An extrusion head for a crushed ice making machine comprising:

a cylindrical body having a top and a bottom;

a plurality of bosses protruding radially outwardly and extending longitudinally along said body;

each of said bosses having two walls forming a series of channels; and a plurality of cutters extending radially outward along said top of said body and extending above said channels.

2. The extrusion head of claim 1 wherein said plurality of bosses comprises eight bosses.

3. The extrusion head of claim 2 wherein said eight bosses comprise alternative wide and narrow bosses.

4. The extrusion head of claim 1 wherein said plurality of bosses comprises an odd number of bosses.

5. The extrusion head of claim 1 wherein each of said cutters forms a wedge.

6. The extrusion head of claim 1 wherein each of said cutters is aligned equidistant between said walls of said channels.

* * * * *